United States Patent [19]

Wagner

[11] 4,221,251

[45] Sep. 9, 1980

[54] BILLFOLD

[76] Inventor: Carl Wagner, 199 Vineyard Rd., Avon Lake, Ohio 44012

[21] Appl. No.: 961,748

[22] Filed: Nov. 17, 1978

[51] Int. Cl.[2] ..... A45C 1/06

[52] U.S. Cl. ..... 150/38; 150/35

[58] Field of Search ..... 150/32, 35, 38, 39

[56] References Cited

U.S. PATENT DOCUMENTS

| | | | |
|---|---|---|---|
| 1,020,537 | 3/1912 | Cardwell | 150/33 |
| 1,920,060 | 7/1933 | Buxton | 150/35 |
| 2,312,132 | 2/1943 | Swanson | 150/35 |
| 2,315,702 | 4/1943 | Herbener | 150/32 |
| 2,346,433 | 4/1944 | Herberner | 150/35 |
| 2,432,558 | 12/1947 | Broughton | 150/32 |
| 2,516,716 | 7/1950 | Mueller | 150/32 |
| 2,788,042 | 4/1957 | Carden | 150/35 |
| 2,863,484 | 12/1958 | Herbener | 150/35 |
| 2,863,485 | 12/1958 | Herbener | 150/35 |
| 2,863,486 | 12/1958 | Herbener | 150/35 |

FOREIGN PATENT DOCUMENTS

| | | | |
|---|---|---|---|
| 392910 | 5/1933 | United Kingdom | 150/32 |

*Primary Examiner*—Herbert F. Ross

*Attorney, Agent, or Firm*—Otto M. Wildensteiner

[57] ABSTRACT

A billfold of utmost simplicity and practicality, produced in only two operations, comprising a folded blank and having separate bill and credit card compartments. The bill compartment allows a portion of the bills to project beyond the body of the billfold so that a desired bill can be grasped and removed without opening up the billfold; a tab covers the projecting portion of the bills. Another tab which forms the end of the credit card pocket can be unfolded to allow access to the credit cards.

3 Claims, 2 Drawing Figures

BILLFOLD

BACKGROUND

Many banks, savings and loan institutions, finance companies etc. give out small gifts that are intended to encourage saving or are otherwise connected with money. These gifts should be useful for their intended purpose and they should be inexpensive, otherwise no bank will be willing to distribute them in large quantities.

Gifts of this sort frequently take the form of some sort of billfold or purse since such an item has the necessary connotation of thrift and saving. Additionally, the institution's name is usually embossed on the item as a gentle reminder to the user that he should add to his account.

Unfortunately the ideas of low cost and great utility usually don't go with each other, since a billfold that has utility usually requires enough manufacturing steps to raise its cost above what an institution is willing to pay for a gift that will be given away in large numbers. Conversely, a low cost billfold either looks cheap or is so flimsy that it reflects against the organization that gives it out.

What is needed therefore is a billfold that requires a minimum of manufacturing operations so that most of its cost can be in the material from which it is made, and which has enough utility to assure that it will be used by those who receive it.

OBJECTS

Accordingly, it is an object of the present invention to provide a billfold of minimum manufacturing steps.

It is a further object to provide a billfold of minimum manufacturing cost.

It is a still further object to provide a billfold of minimum manufacturing steps and cost and of maximum utility.

SUMMARY

Briefly, the present invention is a billfold that is made from a flat blank of leather or imitation leather and has no stitched or glued seams. The blank is folded along its longitudinal centerline to form a pocket which receives the bills and credit cards; it is then folded transversely to separate the bill pocket from the credit card pocket. Fold-over tabs at each end keep the bills and credit cards from falling out of the ends of the pockets.

DESCRIPTION OF THE PREFERRED EMBODIMENT

Figure 1:
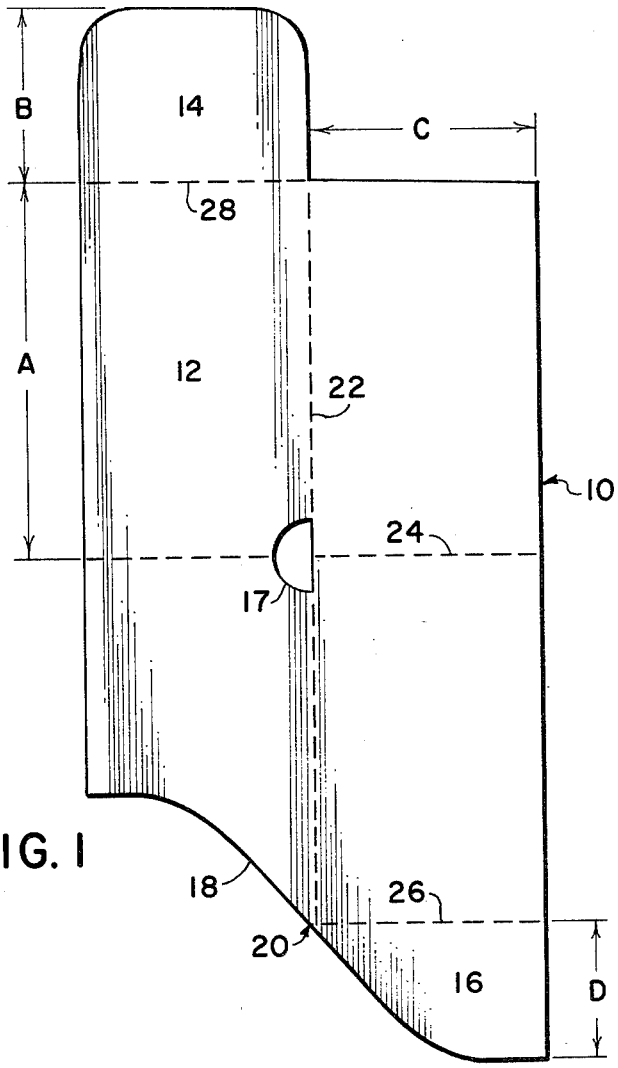
FIG. 1 shows the blank ready to be folded up into the finished billfold.

FIG. 1 shows blank 10 that is ready to be folded into a billfold. Blank 10 comprises a generally rectangular central portion 12 having a generally square tab 14 at one short side and a truncated triangular tab 16 at its other short side; there is also a semi-circular cutout 17 at the intersection of fold lines 22 and 24. Side 18 is the only non-straight side on blank 10; its contours are symmetrical about point 20 as will be explained below. Fold lines 22 along the longitudinal centerline of central portion 12; 24 along the lateral centerline of central portion 12; and 26 and 28, which define tabs 16 and 14, respectively, complete blank 10.

Dimension A, the distance from the lateral centerline of generally rectangular central portion 12 to each short side, is approximately ¾ the length of a dollar bill; dimension B, the length of tab 14, is slightly less than half the length of a bill. Dimension C is slightly more than the width of a bill, while dimension D is of the order of 1 inch.

To form blank 10 into a billfold it is first folded along line 22 to form a pocket for bills and a pocket for credit cards, etc. With the blank oriented as shown in FIG. 1 the pocket above fold line 24 is for bills and the pocket below fold line 24 is for credit cards, etc. Tab 16 is then folded up so that the lower half of side 18 abuts the upper half of side 18, thereby closing the end of the credit card pocket. This is the reason for making side 18 symmetrical about point 20; if it were not there would be an unsightly gap between tab 16 and the rest of blank 10 when tab 16 is folded up, or else there would be an overlapping of tab 16 onto the rest of the billfold which would create an unnecessary and objectionable thickness at that point. Semi-circular cutout 17, which will be on the inside of the billfold when it is folded as shown in FIG. 2, keeps the material from bunching up at that point and allows the billfold to be folded flat.

The pocket above fold line 24 is for bills. This pocket, however, is shorter than dollar bills and consequently they extend out beyond the end of the pocket. Tab 14 is therefore folded over the ends of the bills that extend beyond the end of the pocket.

Figure 2:
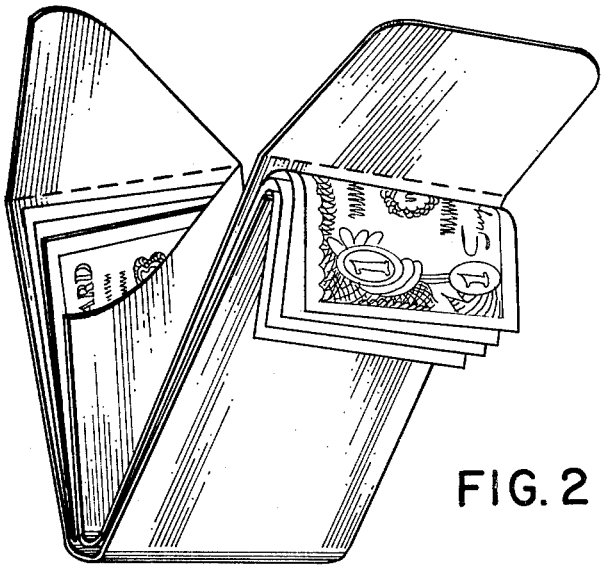
FIG. 2 shows the billfold partially open with bills and credit cards in their respective pockets.

The billfold is then folded along line 24 so that tab 16 is on the inside and tab 14 is on the outside, as shown in FIG. 2.

When it is desired to remove a bill from the billfold, tab 14 is unfolded while the rest of the billfold remains folded along line 24. This exposes a portion of all the bills, and the desired one can be located and removed.

When it is desired to remove a credit card, tab 14 is left folded over and the billfold is unfolded along line 24. Tab 16 is then unfolded to expose a corner of the credit card pocket; the desired one can then be located and removed.

Thus it will be seen that the only manufacturing operations required to make the billfold of the present invention are stamping it out of the flat stock (leather, imitation leather, or any other suitable material) and forming the four fold lines on it. Since these are very inexpensive, the bulk of the cost can be in the material from which it is made; this will enhance its appeal to advertisers and increase its acceptance. The fact that it has separate pockets for bills and for credit cards gives it utility, which will further enhance its appeal.

I claim:

1. A billfold comprising a generally rectangular central portion with a truncated triangular corner portion removed from a shorter side and an otherwise non-indented periphery and having a single fold on its longitudinal centerline and a single fold on its lateral centerline, a generally square tab attached to one of its shorter sides, and a truncated triangular tab attached to its other shorter side.

2. A billfold as in claim 1 wherein said other shorter side has an outer contour that is symmetrical about its center point.

3. A billfold as in claim 2 wherein said generally square tab and said truncated triangular tab are on opposite sides of said longitudinal centerline.

* * * * *